US008790043B2

(12) United States Patent
Tietjen

(10) Patent No.: US 8,790,043 B2
(45) Date of Patent: Jul. 29, 2014

(54) FOUNDATION FOR BUILDINGS

(75) Inventor: Kai Tietjen, Thedinghausen (DE)

(73) Assignee: Soiltec GmbH, Achim (DE)

( * ) Notice: Subject to any disclaimer, the term of this patent is extended or adjusted under 35 U.S.C. 154(b) by 8 days.

(21) Appl. No.: 13/147,701

(22) PCT Filed: Jun. 23, 2009

(86) PCT No.: PCT/EP2009/004511

§ 371 (c)(1),
(2), (4) Date: Sep. 30, 2011

(87) PCT Pub. No.: WO2010/088929

PCT Pub. Date: Aug. 12, 2010

(65) Prior Publication Data

US 2012/0020743 A1 Jan. 26, 2012

(30) Foreign Application Priority Data

Feb. 6, 2009 (DE) ..... 10 2009 007 931

(51) Int. Cl.

| | |
|---|---|
| ***E02D 31/02*** | (2006.01) |
| ***E02D 27/14*** | (2006.01) |
| ***E02D 17/20*** | (2006.01) |
| ***E02D 27/16*** | (2006.01) |

(52) U.S. Cl.

CPC ..... *E02D 27/14* (2013.01); *E02D 17/207* (2013.01); *E02D 27/16* (2013.01)

USPC ..... 405/229; 405/231; 405/302.4

(58) Field of Classification Search

CPC ..... E02D 2200/11; E02D 3/02; E02D 27/12

USPC ..... 405/229, 230, 231, 255, 258.1, 288, 405/302.4–302.7, 262, 284, 16

See application file for complete search history.

(56) References Cited

U.S. PATENT DOCUMENTS

| | | | | |
|---|---|---|---|---|
| 4,778,309 | A * | 10/1988 | Bach et al. | 405/284 |
| 4,797,026 | A | 1/1989 | Webster | |
| 5,160,215 | A * | 11/1992 | Jensen | 404/46 |
| 6,974,278 | B2 * | 12/2005 | Moroschan | 405/258.1 |
| 7,377,726 | B2 * | 5/2008 | Schellhorn | 405/284 |
| 8,173,241 | B2 * | 5/2012 | Halahmi et al. | 428/119 |
| 2003/0024186 | A1 | 2/2003 | Ortega | |
| 2007/0212173 | A1 * | 9/2007 | Schellhorn | 405/287 |
| 2009/0169311 | A1 * | 7/2009 | Sharley et al. | 405/302.6 |

FOREIGN PATENT DOCUMENTS

| | | | |
|---|---|---|---|
| EP | 0611849 | A | 8/1994 |
| JP | 03180610 | A | 8/1991 |
| JP | 2008038511 | A | 2/2008 |
| JP | 2008075389 | A | 4/2008 |
| KR | 100780216 | A | 11/2007 |
| WO | 9200425 | A | 1/1992 |

OTHER PUBLICATIONS

Canadian Intellectual Property Office, Examination Report (for related Canadian patent application No. 2751809) (Jan. 24, 2013).

* cited by examiner

*Primary Examiner* — Thomas B Will
*Assistant Examiner* — Katherine Chu
(74) *Attorney, Agent, or Firm* — Laurence P. Colton; Smith Risley Tempel Santos LLC

(57) ABSTRACT

A foundation for structures, with a combination of pile-like support elements (11) and a load distribution layer (12) which is arranged above the support elements and has an incorporated three-dimensional honeycomb structure.

57 Claims, 3 Drawing Sheets

FOUNDATION FOR BUILDINGS

BACKGROUND OF THE INVENTION

1. Technical Field

The invention relates to a foundation for structures.

2. Prior Art

Structures which are to be erected on soft subsoil can be supported and secured against settlement movements by pile foundations. A load distribution layer is as a rule arranged between the piles (below) and the structures (above) so that the loads originating from the structure can thus be directed into the piles. In order to achieve this object, the load distribution layer must have a specific thickness and be made from a specific material. Load distribution layers of sand are known from the prior art.

BRIEF SUMMARY OF THE INVENTION

The object of the present invention is to modify the load distribution layer in such a way that the foundation as a whole can be constructed in a more cost-effective and stable fashion and/or more quickly.

The foundation according to the invention is a foundation for structures, comprising a combination of pile-like support elements (11); and a load distribution layer (12) which is arranged above said support elements, the load distribution layer (12) having an incorporated three-dimensional matrix-like structure or honeycomb structure. According to these features, the foundation for structures has a combination of pile-like support elements and a load distribution layer arranged above said support elements, a three-dimensional matrix-like structure being incorporated into the load distribution layer. The load distribution layer is here preferably generally a combination of a pourable material, for example sand, with an incorporated honeycomb structure. The latter is intended to prevent or limit in particular transverse movements of the pourable material, that is lateral yielding of the pourable material owing to the static loads of the structures. Advantageously, the pourable material in the load distribution layer has the same height as the honeycomb structure. Alternative arrangements are possible.

It is provided within the scope of the invention that the support elements stand on or in a load-bearing subsoil and extend through an inadequately load-bearing layer as far as the load distribution layer.

A further concept of the invention is that the honeycomb structure has predominantly, in particular exclusively upright walls. "Upright" here means an orientation that is also parallel to the main direction in which the support elements extend. In this way, transverse movements of the pourable material in the load distribution layer are effectively prevented.

In a further concept of the invention, it is provided that the honeycomb structure predominantly, in particular exclusively, has walls which are oriented perpendicularly to the extension of the load distribution layer. Upright walls of the honeycomb structure thus result in a horizontally oriented load distribution layer.

The honeycomb structure is preferably designed so that it is open at the top—in the direction of the structure—and at the bottom—in the direction of the support elements. Water absorption and permeability are thereby optimized.

A further concept of the invention is that a compensation layer, preferably of sand, is provided beneath the load distribution layer and the support elements extend into it. The compensation layer serves to adjust the height of the support elements. The upper end faces of the latter end at approximately the same height. In most cases, exactly identical heights are not possible because of the design. The differences can be compensated by the compensation layer. The thickness of the compensation layer is preferably 1 cm to 10 cm. The thicker the compensation layer, the greater too its additional load-distributing effect. Ideally, no compensation layer is provided.

A further concept of the invention is that the honeycomb structure has cavities with a width of 25 cm or greater. The width should here be measured in a direction parallel to the extension of the load distribution layer. If possible, the cavities all have approximately the same size. Accordingly, the cavities do not have a circular cross section. The specified width preferably relates to the smallest width within a cavity. A larger width can also result, depending on the direction of measurement.

According to the invention, the honeycomb structure can have walls and/or cavities with a height of 5 cm to 15 cm. The height then preferably extends in a direction perpendicular to the extension of the load distribution layer. Surprisingly, experiments have shown that diameters or rather walls with a height from just 5 cm to 15 cm suffice for specific applications even in the case of larger cavities of 25 cm. As a result, the load distribution layer as a whole can be designed to be relatively thin. Accordingly, the amount of material used is reduced. At the same time, construction time is shortened.

In a further concept of the invention, it is provided that the honeycomb structure has perforated walls with a perforation of 0% to 40% of the total wall surface. The perforations, for example in the form of bores or other openings which are arranged the same distance apart from one another, make the walls permeable to water and fine grains. 0% corresponds to a design with no perforations.

According to the invention, the honeycomb structure can be formed from corrugated strips, wherein the strips are connected to one another in the region of corrugation peaks and corrugation troughs. When the walls have an upright arrangement, the corrugation peaks and troughs are not situated at the top and bottom but laterally offset relative to each other. Large-surface honeycomb structures can be formed quickly and simply with the described strips.

A further concept of the invention is that the honeycomb structure has adjacent cells or cavities with a surface area of 400 $cm^2$ or greater. The surface area is here preferably measured parallel to the extension of the load distribution layer.

According to the invention, the honeycomb structure can have adjacent cells with walls which are connected to walls of other and/or the same cells, wherein force-fitting connections between the walls are designed for a loading of preferably approximately 1 kN in each case. Connections which can be loaded in this way effectively prevent the interconnected walls from being separated or the honeycomb structure as a whole from failing, and do so for most applications.

In a further concept of the invention, it is provided that the honeycomb structure has walls made of HDPE or other polymeric materials. HDPE (high density polyethylene) is a durable material which can withstand high loads and, depending on the thickness, is flexible. The walls can also be formed from nonwoven fabrics.

The honeycomb structure has in particular walls between 1 mm and 3 mm thick. Walls with a thickness between 1 mm and 2 mm are preferably provided. The design of the walls tends to be thicker, the more perforations there are provided.

The support elements are advantageously columns with a 40 cm to 80 cm diameter and can, for example, be cast from concrete. A grid arrangement of the support elements is preferred, with a spacing of 1.50 m to 3.50 m from one another.

In a further concept of the invention, it is provided that a nonwoven fabric is provided on or in the compensation layer. The nonwoven fabric is preferably a water-permeable textile layer, by means of which, for example, a mingling of material above and below the nonwoven fabric is prevented. A nonwoven fabric is advantageously arranged directly beneath the load distribution layer.

A further concept of the invention is that two or more load distribution layers are arranged above one another, with spacings of preferably 0 cm to 50 cm, wherein the support elements can reach as far as the lower load distribution layer. Experiments have shown that two load distribution layers one above the other can achieve better results than a single load distribution layer with the same total thickness as the two load distribution layers. This effect can be explained by the compacting of the material within the load distribution layer. The material can be better compacted in two flat load distribution layers one after the other than in a single high load distribution layer. It is also possible to arrange more than two load distribution layers one above the other with or without gaps.

In a further concept of the invention, it is provided that compensation layers, preferably 0 cm to 50 cm thick, are in each case arranged between the load distribution layers. One compensation layer is advantageously situated in each case between two load distribution layers.

In a further concept of the invention, it is provided that one or more compensation layers have a changing thickness profile. A lower compensation layer between a load distribution layer and support elements compensates tolerances when the support elements settle. Other adjustments can be made to the required precise height of the foundation by means of a changing thickness of a further compensation layer between two load distribution layers.

A nonwoven fabric, which may optionally be present, is advantageously arranged at least below the lowest load distribution layer in the case of multiple load distribution layers. Nonwoven fabrics can, however, also be provided below further or below all load distribution layers.

It is within the scope of the invention to use the foundation with one or more of the abovementioned features for road surfaces, traffic routes, logistics areas
embankments, dams,
bridges and/or
tall buildings.

BRIEF DESCRIPTION OF THE DRAWINGS

Other features of the invention are apparent from the description and from the claims. Advantageous exemplary embodiments of the invention are explained in more detail below with reference to drawings, in which:

DETAILED DESCRIPTION OF PREFERRED EMBODIMENTS

Figure 1:
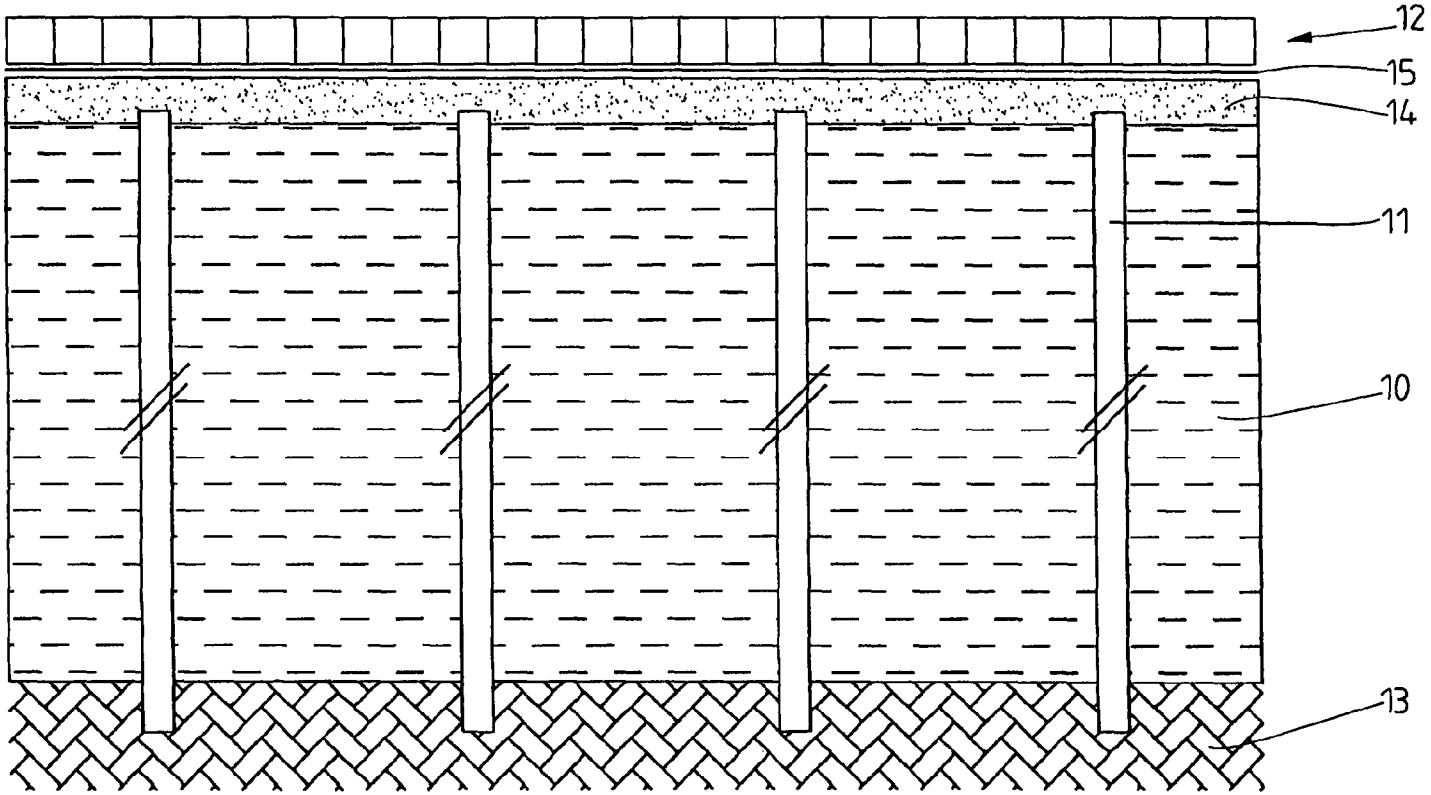
FIG. 1 shows a cross section through a foundation according to the invention.

It is intended for a structure, not shown, to be erected on a non load-bearing subsoil, namely a soft layer 10. In order to be able to erect the structure securely, a special foundation is provided. The latter here has column-like support elements 11 and a load distribution layer 12 arranged above said support elements 11.

The support elements 11 are here designed as concrete columns which stand upright and extend through the whole soft layer 10 as far as a load-bearing subsoil 13 below the soft layer 10. Upper ends of the support elements 11 project into a compensation layer 14 of compacted sand. Any differences in height which exist between the support elements are compensated by the compensation layer 14. At the same time, the compensation layer 14 can contribute to the distribution of loads.

The compensation layer 14 is covered by a water-permeable textile layer, a nonwoven fabric 15. Arranged directly on top of the nonwoven fabric 15 is the load distribution layer 12 on which, for example, a frost protection layer and a road surface (not shown) can lie, or an embankment structure.

The load distribution layer 12 preferably has an incorporated three-dimensional honeycomb structure. The honeycomb structure is filled with compacted sand. Loads resting on the load distribution layer 12 are directed through the sand and the honeycomb structure into the support elements 11.

The three-dimensional honeycomb structure of the load distribution layer 12 consists of plastic strips 16 arranged in a meandering shape and with upright walls. The meandering shape creates the impression for each plastic strip 16 of an almost sinusoidal profile. Mutually adjacent plastic strips 16 are—in terms of a sine curve—offset by 180° to one another so that cavities 17 or honeycomb cells which are open at the top and bottom result.

For installing the honeycomb structure on the construction site, multiple plastic strips 16 are connected to one another in advance to form a honeycomb unit 18. On the construction site, multiple honeycomb units 18 are then connected to one another in force-fitting fashion in the region of outer arcs 19 and projecting fins 20. To achieve this, connecting means (not shown) are used, for example of a mechanical type or by adhesive bonding or welding. The fins 20 are formed by interconnected ends of adjacent plastic strips 16.

Figures 2, 3:
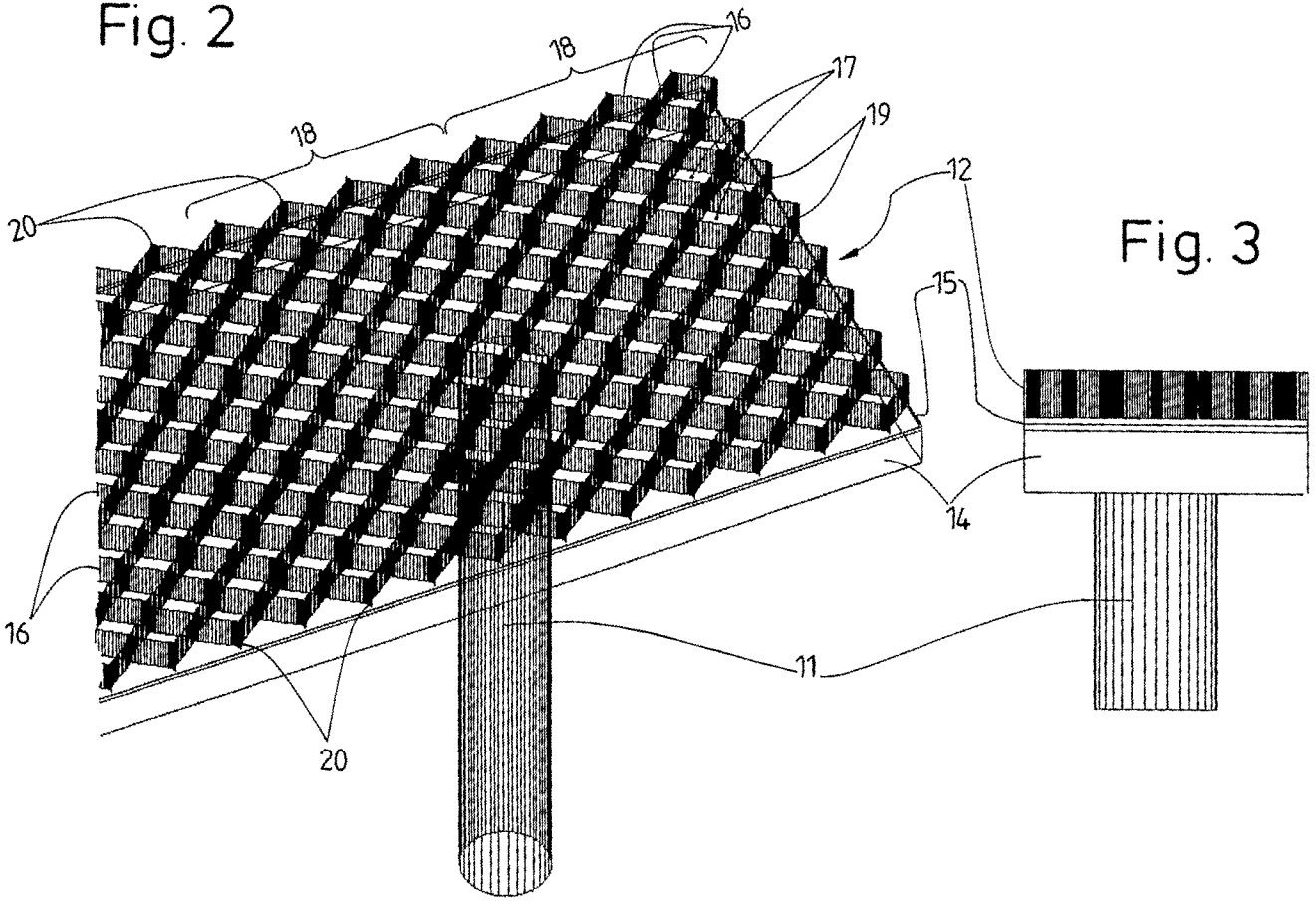
FIG. 2 shows a perspective view of a part of the foundation.
FIG. 3 shows a cross section of FIG. 2.

To simplify matters, in FIGS. 2 and 3 the soft layer 10 and the load-bearing subsoil 13 are not indicated, and neither is the compacted sand present in the honeycomb structure.

The height of the honeycomb structure, and accordingly of the perforated plastic strips 16 and the load distribution layer 12 too, is approximately 5 cm to 15 cm with a width of the individual cavities 17 or honeycomb cells of more than 25 cm and/or a surface area covered by the cavities 17 of more than 400 $cm^2$ in each case. The compensation layer 14 should be as thin as possible and has a thickness of approximately 1 cm to 20 cm. Ideally, no compensation layer is provided.

The support elements 11 are here designed as concrete columns with a diameter of approximately 40 cm to 80 cm. The individual columns in the grid here have a spacing of approximately 2 m to 3.50 m.

The connections between the adjacent or consecutive plastic strips 16 are designed for a tensile force of approximately 1 kN. HDPE with a wall thickness of 1 mm to 2 mm is preferably used as the material.

Figures 4, 5:
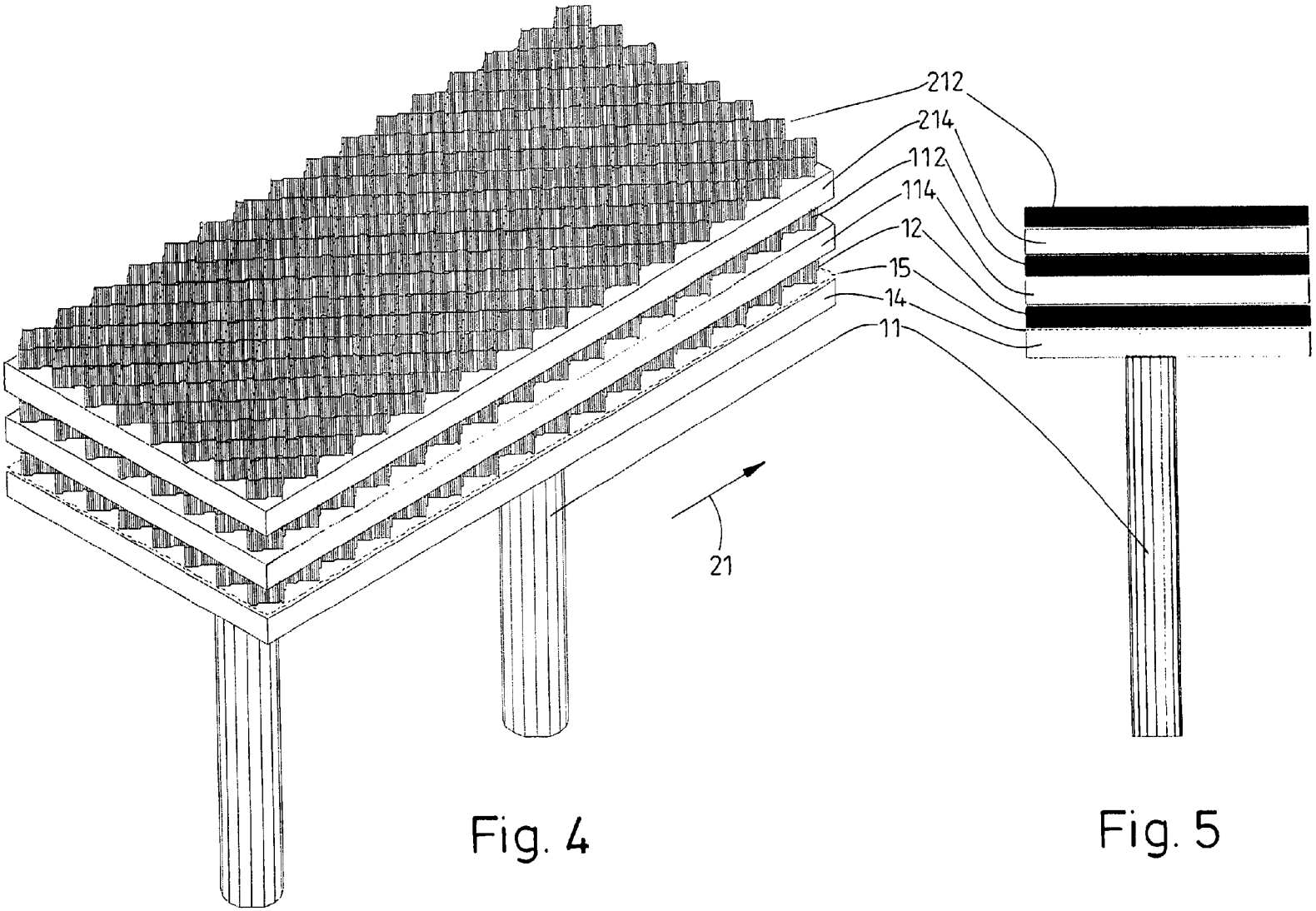
FIG. 4 shows a perspective view of the foundation similar to FIG. 2 but with three load distribution layers and compensation layers respectively.
FIG. 5 shows a cross section of FIG. 4.

FIGS. 4 and 5 show an extension of the foundation shown in FIGS. 2 and 3. In all, three load distribution layers 12, 112, 212 and three compensation layers 14, 114, 214 are provided, alternating with one another. The nonwoven fabric 15 lies between the lower load distribution layer 12 and the lower compensation layer 14.

The support elements 11 reach as far as the lower compensation layer 14 or extend into the latter, as also shown in FIG. 1.

The compensation layers 14 are here designed in the longitudinal extension of the structure—arrow 21—with a uniform thickness. However, different thicknesses are also possible in the direction of extension, in particular to compensate different heights between the soft layer 10, on the one hand, see FIG. 1, and the required height of the structure above the topmost load distribution layer 212, on the other hand.

The use of multiple superposed load distribution layers 12, 112, 212 is particularly advantageous as a greater compaction of the material can be obtained within each load distribution layer than for a single relatively high load distribution layer.

LIST OF REFERENCE NUMERALS

10 soft layer
11 support elements
12 load distribution layer
13 load-bearing subsoil
14 compensation layer
15 nonwoven fabric
16 plastic strips
17 cavities
18 honeycomb units
19 arcs
20 fins
21 arrow
112 load distribution layer
114 compensation layer
212 load distribution layer
214 compensation layer

What is claimed is:

1. A foundation for a structure, comprising:

a combination of pile support elements (11);

a load distribution layer (12) which is arranged above the support elements, the load distribution layer (12) having an incorporated three-dimensional matrix or honeycomb structure, the load distribution layer for directing loads originating from a structure into the support elements (11), wherein the support elements (11) do not extend into or above the load distribution layer (12); and a height adjusting compensation layer (14) provided below the load distribution layer (12) and/or a material mingling preventative nonwoven fabric (15) arranged beneath the load distribution layer (12), the height adjusting compensation layer being in contact with the support elements (11) and being constructed and arranged to adjust the height of the support elements wherein differences in heights of the support elements are compensated for by the height adjusting compensation layer (14), and the material mingling preventative nonwoven fabric (15) not being in contact with the support elements (11) and being constructed and arranged to prevent mingling of material above the material mingling preventative nonwoven fabric (15) with material below the material mingling preventative nonwoven fabric (15).

2. The foundation as claimed in claim 1, wherein the support elements (11) stand on or in a load-bearing subsoil (13) and extend through an inadequately load-bearing layer (10) as far as the load distribution layer (12) or, if the height adjusting compensation layer (14) is provided, into the height adjusting compensation layer (14) from below.

3. The foundation as claimed in claim 1, wherein the load distribution layer (12) is the honeycomb structure, and the honeycomb structure has upright walls.

4. The foundation as claimed in claim 3, wherein the honeycomb structure has upright walls which are oriented perpendicularly to the extension of the load distribution layer (12).

5. The foundation as claimed in claim 1, comprising the height adjusting compensation layer (14) provided below the load distribution layer (12), wherein the support elements (11) extend into the height adjusting compensation layer (14) from below, or wherein the support elements (11) reach as far as the load distribution layer.

6. The foundation as claimed in claim 3, wherein the honeycomb structure comprises cavities (17) each having a smallest width of 25 cm or greater.

7. The foundation as claimed in claim 3, wherein the honeycomb structure comprises walls (16) and/or cavities (17) having a height of 5 cm to 15 cm.

8. The foundation as claimed in claim 3, wherein the honeycomb structure comprises perforated walls with a perforation of 0% to 40% of the total wall surface.

9. The foundation as claimed in claim 3, wherein the honeycomb structure is formed from corrugated strips (16), and wherein the strips are connected to one another in the region of corrugation peaks and corrugation troughs or arcs.

10. The foundation as claimed in claim 3, wherein the honeycomb structure comprises adjacent cells or cavities each having a surface area of 400 $cm^2$ or greater.

11. The foundation as claimed in claim 3, wherein the honeycomb structure comprises adjacent cells with walls which are connected to walls of other and/or the same cells.

12. The foundation as claimed in claim 3, wherein the honeycomb structure comprises walls made from high density polyethylene (HDPE), from other polymeric materials, or from nonwoven fabrics.

13. The foundation as claimed in claim 3, wherein the honeycomb structure comprises walls 1 mm to 3 mm thick.

14. The foundation as claimed in claim 1, wherein the support elements (11) are columns having a diameter of 40 cm to 80 cm.

15. The foundation as claimed in claim 14, wherein the support elements (11) are cast from concrete.

16. The foundation as claimed in claim 1, wherein the support elements (11) are arranged with a spacing of 1.50 m to 3.50 m from one another.

17. The foundation as claimed in claim 5, further comprising both the material mingling preventative nonwoven fabric (15) and the height adjusting compensation layer (14), wherein the material mingling preventative nonwoven fabric (15) is provided on or in the height adjusting compensation layer (14).

18. The foundation as claimed in claim 1, further comprising at least an additional load distribution layer (112, 212) arranged above the load distribution layer (12), with a spacing of 0 cm to 50 cm from one another, wherein the support elements (11) reach as far as the load distribution layer (12).

19. The foundation as claimed in claim 18, further comprising at least an additional height adjusting compensation layer (114, 214) arranged between at least two of the load distribution layers (12, 112, 212), respectively.

20. The foundation as claimed in claim 19, wherein at least one of the height adjusting compensation layers (14, 114, 214) has a changing thickness profile.

21. The foundation as claimed in claim 3, wherein the matrix or honeycomb structure comprises walls 1 mm to 2 mm thick.

22. The foundation as claimed in claim 3, wherein the load distribution layer (12) is a combination of a pourable material with the matrix or honeycomb structure.

23. The foundation as claimed in claim 11, further comprising force fitting connections between the walls, the force fitting connections having a loading capacity of approximately 1 kN each.

24. The foundation as claimed in claim 19, wherein each of the height adjusting compensation layers (14, 114, 214) has a thicknesses of 0 cm to 50 cm.

25. The foundation as claimed in claim 1, wherein the material mingling preventative nonwoven fabric (15) is arranged above the pile support elements (11).

26. The foundation as claimed in claim 1, wherein the material mingling preventative nonwoven fabric is a water-permeable textile layer.

27. The foundation as claimed in claim 1, wherein the compensation layer (14) comprises compacted sand.

28. A foundation for a structure selected from the group consisting of:

road surfaces, traffic routes, logistics areas, embankments, dams, bridges, and tall buildings, the foundation comprising:

a combination of pile support elements (11);

a load distribution layer (12) which is arranged above said support elements, the load distribution layer (12) having an incorporated three-dimensional matrix or honeycomb structure, the load distribution layer for directing loads originating from a structure into the support elements (11), wherein the support elements (11) do not extend into or above the load distribution layer (12); and a height adjusting compensation layer (14) provided below the load distribution layer (12) and/or a material mingling preventative nonwoven fabric (15) arranged beneath the load distribution layer (12), the height adjusting compensation layer being in contact with the support elements (11) and being constructed and arranged to adjust the height of the support elements wherein differences in heights of the support elements are compensated for by the height adjusting compensation layer (14), and the material mingling preventative nonwoven fabric (15) not being in contact with the support elements (11) and being constructed and arranged to prevent mingling of material above the material mingling preventative nonwoven fabric (15) with material below the material mingling preventative nonwoven fabric (15).

29. The foundation as claimed in claim 28, wherein the material mingling preventative nonwoven fabric is a water-permeable textile layer.

30. The foundation as claimed in claim 28, wherein the compensation layer (14) comprises compacted sand.

31. A foundation for a structure, comprising:

a combination of pile support elements (11);

a load distribution layer (12) which is arranged above said support elements, the load distribution layer (12) having an incorporated three-dimensional matrix or honeycomb structure, the load distribution layer for directing loads originating from a structure into the support elements (11), wherein the support elements (11) do not extend into or above the load distribution layer (12); and a height adjusting compensation layer (14) provided below the load distribution layer (12), the height adjusting compensation layer being in contact with the support elements (11) and being constructed and arranged to adjust the height of the support elements (11) wherein differences in heights of the support elements (11) are compensated for by the height adjusting compensation layer (14).

32. The foundation as claimed in claim 31, wherein the support elements (11) stand on or in a load-bearing subsoil (13) and extend through an inadequately load-bearing layer (10) into the compensation layer (14) from below.

33. The foundation as claimed in claim 32, further comprising a material mingling preventative nonwoven fabric (15), the material mingling preventative nonwoven fabric (15) being located on or in the height adjusting compensation layer (14) and not being in contact with the support elements (11), and the material mingling preventative nonwoven fabric (15) constructed and arranged to prevent mingling of material above the material mingling preventative nonwoven fabric (15) with material below the material mingling preventative nonwoven fabric (15).

34. The foundation as claimed in claim 33, wherein the material mingling preventative nonwoven fabric (15) is located between the load distribution layer (12) and the height adjusting compensation layer (14).

35. The foundation as claimed in claim 34, wherein the material mingling preventative nonwoven fabric is a water-permeable textile layer.

36. The foundation as claimed in claim 31, wherein the compensation layer (14) comprises compacted sand.

37. A foundation for a structure, comprising:

a combination of pile support elements (11);

a load distribution layer (12) which is arranged above said support elements, the load distribution layer (12) having an incorporated three-dimensional matrix or honeycomb structure, the load distribution layer for directing loads originating from a structure into the support elements (11), wherein the support elements (11) do not extend into or above the load distribution layer (12); and a material mingling preventative nonwoven fabric (15) arranged beneath the load distribution layer (12), the nonwoven fabric (15) not being in contact with the support elements (11) and being constructed and arranged to prevent mingling of material above the material mingling preventative nonwoven fabric (15) with material below the material mingling preventative nonwoven fabric (15).

38. The foundation as claimed in claim 37, wherein the support elements (11) stand on or in a load-bearing subsoil (13) and extend through an inadequately load-bearing layer (soft layer 10) as far as the material mingling preventative nonwoven fabric (15).

39. The foundation as claimed in claim 38, further comprising a height adjusting compensation layer (14) provided below the load distribution layer (12), the height adjusting compensation layer (14) being in contact with the support elements (11), wherein the support elements (11) extend into the height adjusting compensation layer (14) from below.

40. The foundation as claimed in claim 39, wherein the material mingling preventative nonwoven fabric (15) is provided on or in the height adjusting compensation layer (14).

41. The foundation as claimed in claim 40, wherein the material mingling preventative nonwoven fabric (15) is located between the load distribution layer (12) and the height adjusting compensation layer (14).

42. The foundation as claimed in claim 41, wherein the material mingling preventative nonwoven fabric (15) is a water-permeable textile layer.

43. The foundation as claimed in claim 39, wherein the compensation layer (14) comprises compacted sand.

44. A foundation for a structure, comprising:

a) a combination of pile support elements (11);

b) a load distribution layer (12) positioned above said support elements (11) and configured to direct loads originating from a structure into the support elements (11), i) the load distribution layer (12) having a honeycomb structure with upright walls, comprising high density polyethylene (HDPE), other polymeric materials, or nonwoven fabrics, ii) the support elements (11) having heights that do not extend above the load distribution layer (12);

c) a height adjusting compensation layer (14) operably positioned below the load distribution layer (12) and configured to compensate differences in heights of the support elements (11); and d) a material mingling preventative nonwoven fabric (15) operably positioned on or in the height adjusting compensation layer (14), the nonwoven fabric (15) being a water permeable textile configured to prevent mingling of material above the nonwoven fabric (15) with material below the nonwoven fabric (15).

45. The foundation as claimed in claim 44, wherein the load distribution layer (12) is arranged directly on top of the nonwoven fabric (15).

46. The foundation as claimed in claim 44, wherein the support elements (11) extend into the compensation layer (14).

47. The foundation as claimed in claim 44, wherein the load distribution layer (12) is a combination of pourable material with the incorporated honeycomb structure.

48. The foundation as claimed in claim 44, wherein the support elements (11) stand on or in a load-bearing subsoil (13) and extend through an inadequately load-bearing layer (10) as far as the load distribution layer (12).

49. The foundation as claimed in claim 44, wherein the upright walls of the honeycomb structure are oriented perpendicularly to the extension of the load distribution layer (12).

50. The foundation as claimed in claim 44, wherein the honeycomb structure comprises cavities (17) each having a smallest width of 25 cm or greater.

51. The foundation as claimed in claim 44, wherein the honeycomb structure comprises walls and/or cavities (17) having a height of 5 cm to 15 cm.

52. The foundation as claimed in claim 44, wherein the honeycomb structure comprises perforated walls with a perforation of 0% to 40% of the total wall surface.

53. The foundation as claimed in claim 44, wherein the honeycomb structure comprises walls 1 mm to 3 mm thick.

54. The foundation as claimed in claim 44, wherein the support elements (11) are columns having a diameter of 40 cm to 80 cm.

55. The foundation as claimed in claim 44, wherein the support elements (11) are cast from concrete.

56. The foundation as claimed in claim 44, wherein the support elements (11) are arranged with a spacing of 1.50 m to 3.50 m from one another.

57. The foundation as claimed in claim 44, wherein the compensation layer (14) comprises compacted sand.

* * * * *